US005947476A

United States Patent [19]

Rousay

[11] Patent Number: 5,947,476

[45] Date of Patent: Sep. 7, 1999

[54] WATER BALLOON TARGET GAME

[76] Inventor: Robert W. Rousay, 32 Kendall St., North Attleboro, Mass. 02760

[21] Appl. No.: 09/094,125

[22] Filed: Jun. 9, 1998

Related U.S. Application Data

[60] Provisional application No. 60/049,986, Jun. 13, 1997.

[51] Int. Cl.[6] ..... A63B 63/00; F41J 5/00

[52] U.S. Cl. ..... 273/384

[58] Field of Search ..... 273/384

[56] References Cited

U.S. PATENT DOCUMENTS

| | | | |
|---|---|---|---|
| 1,021,019 | 3/1912 | Van Kannel | 273/384 |
| 2,202,738 | 5/1940 | Keller | 273/384 |
| 4,093,228 | 6/1978 | Pierce | 273/384 |
| 4,243,220 | 1/1981 | Shelley | 273/458 |
| 4,702,480 | 10/1987 | Popeski et al. | 273/384 |
| 4,909,518 | 3/1990 | Erlandson et al. | 273/357 |
| 5,087,054 | 2/1992 | O'Neil | 273/384 |
| 5,482,292 | 1/1996 | Stone | 273/384 |
| 5,839,981 | 11/1998 | Rodell et al. | 273/384 X |
| 5,848,793 | 12/1998 | Cells | 273/384 |

*Primary Examiner*—William H. Grieb

*Attorney, Agent, or Firm*—John A. Haug

[57] ABSTRACT

A water balloon target game for bursting a water filled balloon above a game participant includes a frame of base support members (30, 32), a front and a side participant protector screen (36,38), a plurality of water balloon support members (12, 12*a*, 12*b*), a water balloon support seat (14), and an impact activating balloon bursting device (20) with an associated connecting rod (24) which mounts a cocking pin (22) at one end and a target (26) at an opposite end exterior of the frame. The base support members surround a conventional seat (not shown) and provide attachment for the protector screens by hook clips (34) at the front and target sides of the frame. The balloon support seat (14), of a predetermined size and adapted to support a variety of sizes of water balloons, is connected to the balloon support members and is centered above the seat which is occupied by the game participant. In operation, the balloon bursting device is cocked and a filled water balloon is placed on the balloon support seat. When the target is impacted by a projectile such as a tennis ball, the connecting rod pivots, releasing the balloon bursting device thereby bursting the balloon and immediately discharging its contents on the game participant.

14 Claims, 8 Drawing Sheets

WATER BALLOON TARGET GAME

This application claims the benefit of U.S. provisional application No. 60/049,986, filed Jun. 13, 1997.

BACKGROUND OF THE INVENTION

1. Field of the Invention

This invention relates generally to an amusement game and more specifically to a water balloon target game.

2. Description of the Related Art

Water target games have long been a source of amusement and entertainment at carnivals, fairs, amusement parks, circuses and the like. Van Kannel, in U.S. Pat. Nos. 1,021,019, Keller, in 2,202,738 and O'Neil, in 5,087,054, each discloses an amusement apparatus in which a target, impacted by a projectile, releases a support or seat occupied by a person who is then dropped into a tank of water. These games are expensive, complicated in construction, large in size, require large volumes of water and have an inherent danger where the game participant is often plunged and submerged in a water filled tank.

Popeski and Pierce, in U.S. Pat. No. 4,702,480, disclose a water dumping game including a flush toilet with a target actuator mounted on a toilet support structure. This apparatus requires a hot and cold pressurized water source to recharge the toilet tank after each discharge. The flush toilet requires a substantial support structure. The toilet also incorporates a delay from the time when the target is impacted to when the water is discharged.

Franklin Pierce, in U.S. Pat. No. 4,093,228, discloses a water dumping target game including a bucket, adapted to be filled with water, having a release device for tilting the bucket. The release device includes a target which, when struck by a projectile, causes a lanyard to disengage, causing the bucket to pivot outwardly and dump water onto the area below. This device also requires a pressurized water source to refill the bucket after each discharge. This device offers no protection from the projectiles for anyone positioned in the area of the discharging bucket.

Shelley, in U.S. Pat. No. 4,243,220, discloses a game for bursting balloons with pressurized water that are suspended over players participating in the game. Erlandson and Wong, in U.S. Pat. No. 4,909,518 discloses a game where participants positioned inside enclosures launch water balloons from within their enclosures to impact on another similar enclosure to splash the enclosure's occupant. Both of these games are complex in construction and neither of them provides the entertainment derived from a target feature for game participants.

SUMMARY OF THE INVENTION

It is an object of the present invention to provide a simple, compact and inexpensive water balloon target game which is easy to operate and which does not subject the game participant to the various inherent dangers of the above noted prior art.

Another object of the invention is to provide a portable water balloon target game such that its use is not restricted to the availability of a pressurized water source or large volumes of water.

Yet another object of the invention is to provide a water balloon target game in which an impact activating force applied to a target triggers a balloon bursting device that immediately discharges the contents of a water balloon positioned above a game participant.

Briefly stated, a water balloon target game made in accordance with a preferred embodiment of the invention comprises a frame enclosing a location adapted to receive a game participant seat with a foraminous balloon support seat vertically aligned with and above the location adapted to receive the game participant seat. A balloon bursting device is mounted on the frame adjacent to the support seat which includes an elongated member having a free distal end movable between a first balloon bursting position and a second cocked position, and being biased toward the first balloon bursting position. At least one balloon bursting pin is mounted on the elongated member and extends through the foraminous balloon support seat in the first position of the elongated member. A connecting rod having a longitudinal axis and first and second opposite ends is rotatably mounted on the frame for rotation about the longitudinal axis, and a radially extending cocking pin is fixedly attached to the connecting rod and aligned with the free distal end of the elongated member. The cocking pin is engageable with the elongated member when the elongated member is in the second position and when the cocking pin is disposed in a selected angular orientation preventing movement of the member to the first position. A target is attached to an end of the connecting rod so that a selected force, applied to the target by a thrown projectile, will cause the connecting rod to pivot, moving the cocking pin away from the elongated member, allowing the elongated member to move to the first position with the balloon bursting pin received through the foraminous balloon support seat to burst a water filled balloon received on the foraminous seat to allow water to fall on the game participant seat.

According to a feature of the invention, the elongated member is formed of suitable material, such as plastic, having a selected elastic limit, with the elongated member having a suitable configuration, such as cylindrical, being split from the free distal end for a selected length forming an upper and a lower tongue portion. The lower portion includes the movable free end and a slot is formed in the upper portion aligned with the balloon bursting pin that is attached to the lower portion. The balloon bursting means is cocked by pulling the lower portion of the elongated member downwardly, within its elastic limit, and turning the connecting rod so that the cocking pin engages the free distal end of the lower portion.

According to another feature of the invention, the upper portion of the cylindrical elongated member is connected to a fixed T-shaped tubular member with the connecting rod rotatably received within the fixed T-shaped tubular member. An aperture is formed in the fixed T-shaped tubular member, aligned with the cylindrical elongated member with the cocking pin extending from the connecting rod through the aperture for engagement with the lower portion of the elongated member.

According to yet another feature of the invention, screen panels having attachment clips engageable with the frame are provided with one screen panel clipped to the frame in front of the location adapted to receive the game participant seat and another screen panel clipped to the frame adjacent to the target, protecting the game participant while still maintaining his/her visibility to the audience.

According to still another feature, the frame comprises a plurality of horizontal and vertical elongated members having interfitting male and female sockets with press fit connections.

According to another feature of the invention, an arm, extending in a given direction, interconnects the target and the connecting rod with the cocking pin extending from the connecting rod in approximately the same given direction so that when the target is struck causing the connecting rod to pivot, the cocking pin is moved away from the lower portion of the elongated member permitting it to spring back to the upper portion. The arm offsets the target from the longitudinal axis of the connecting rod to provide an effective lever arm which also results in utilizing gravity to urge the target and the connecting rod toward the cocking position.

BRIEF DESCRIPTION OF THE DRAWINGS

The present invention will be more fully understood and appreciated from the following detailed description taken in conjunction with the drawings in which dimensions of certain parts may have been altered for the purpose of illustration and in which.

DETAILED DESCRIPTION OF THE PREFERRED EMBODIMENT

Figure 1:
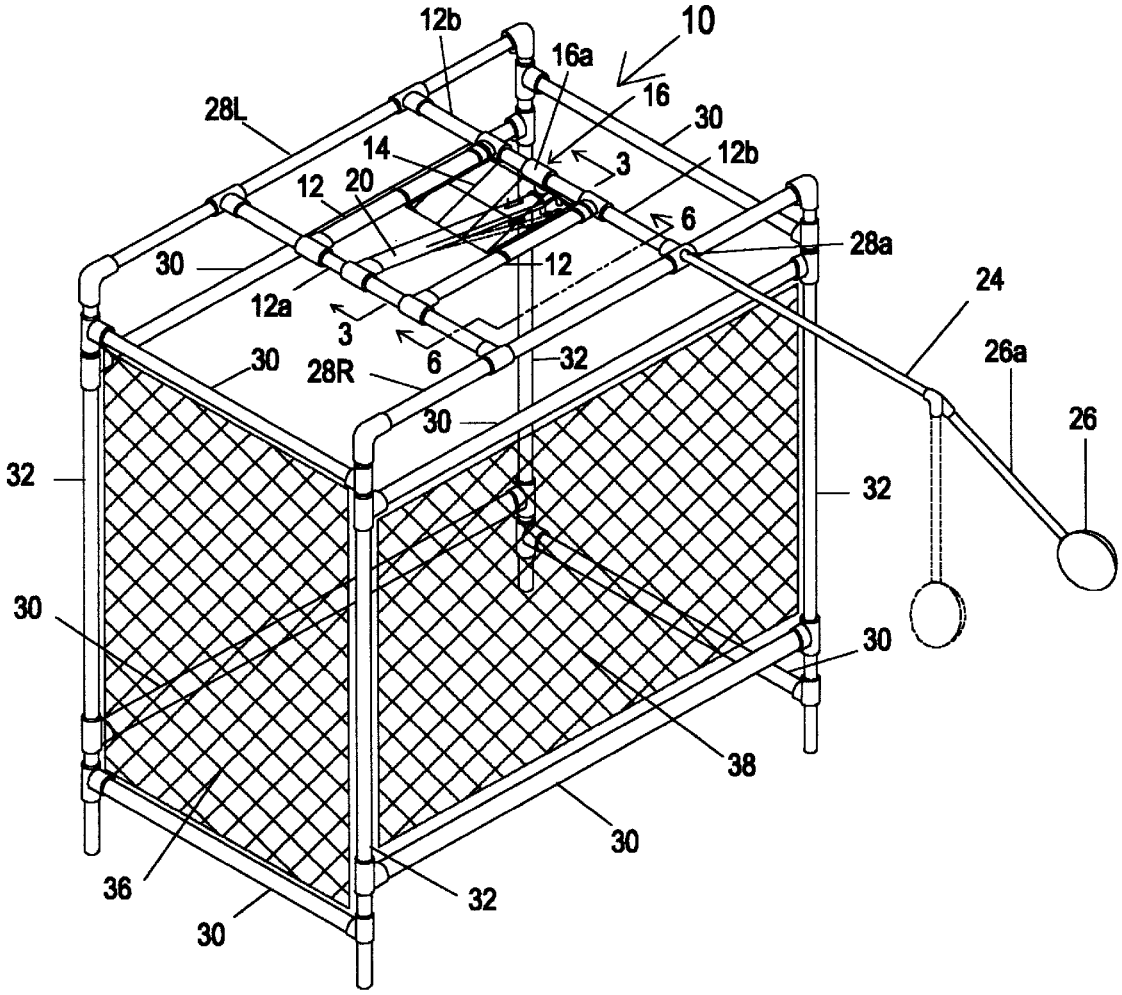
FIG. 1 is a perspective view of a water balloon target game made in accordance with a preferred embodiment of the invention shown with the balloon bursting device in the solid line tripped position and dashed line cocked position.
Figure 3:
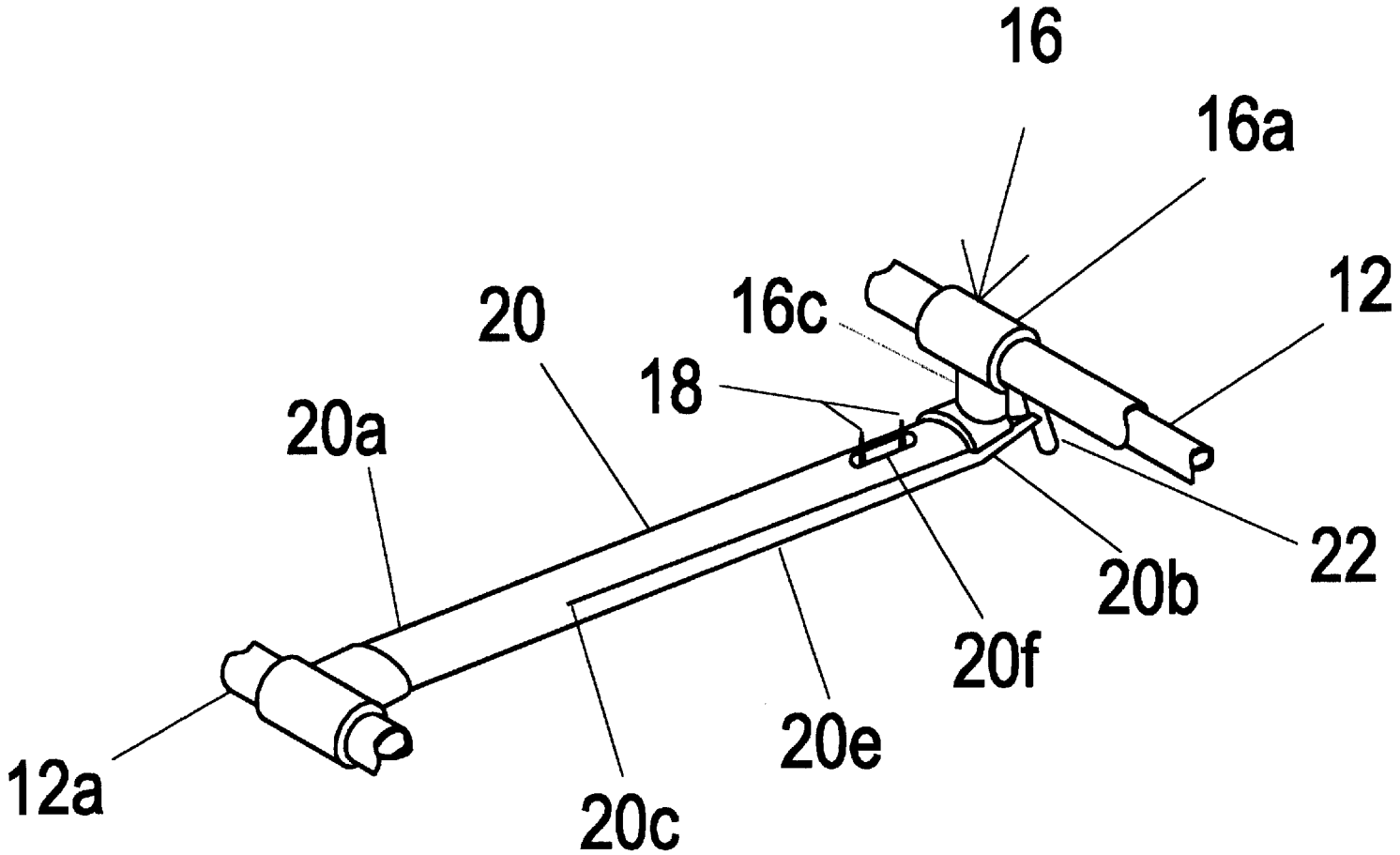
FIG. 3 is an enlarged perspective view of the portion indicated by lines 3—3 if FIG. 1 showing the balloon bursting device in the tripped position.
Figure 4:
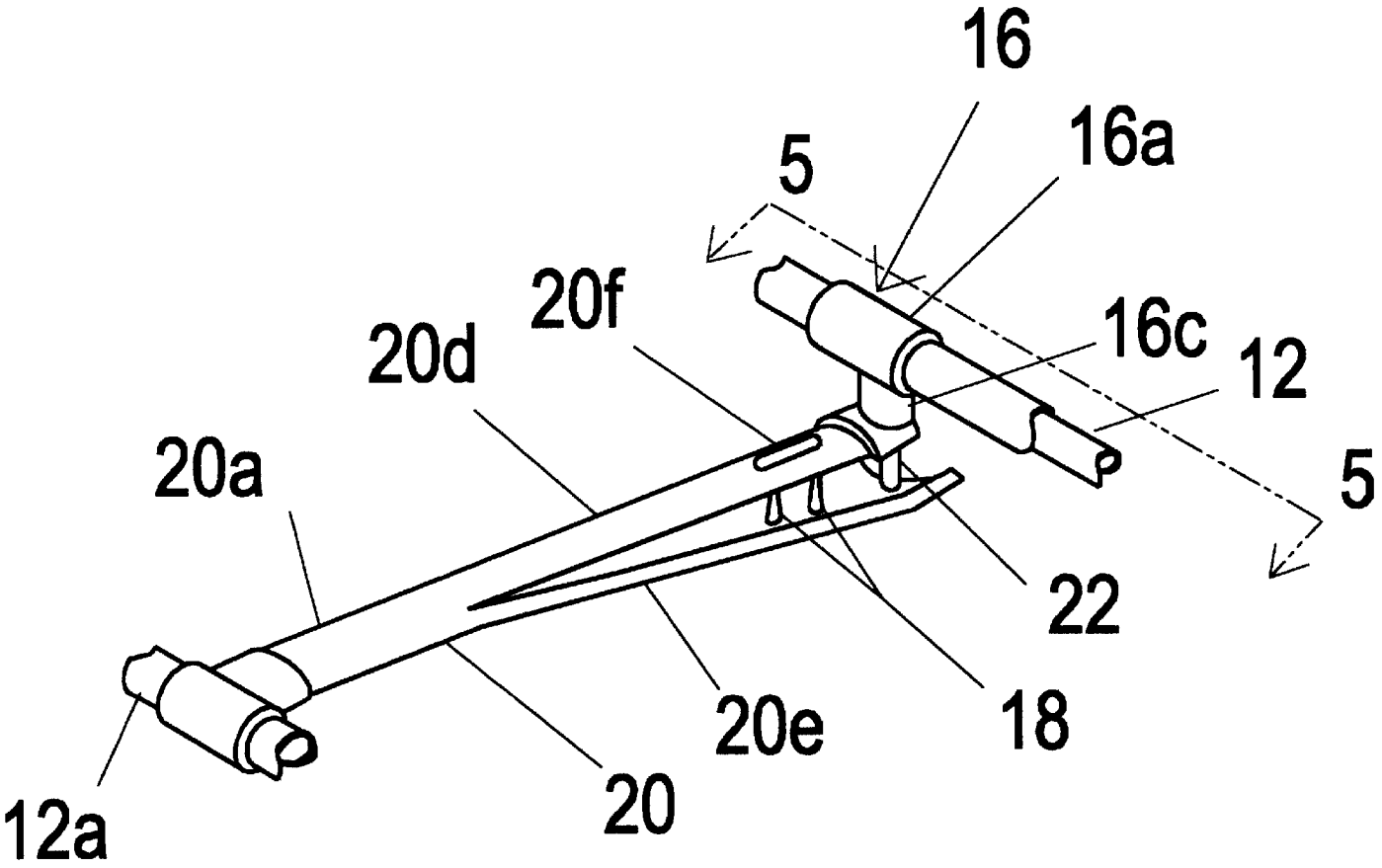
FIG. 4 is a view similar to FIG. 3 of the balloon bursting device in the cocked or untripped position.
Figure 5:
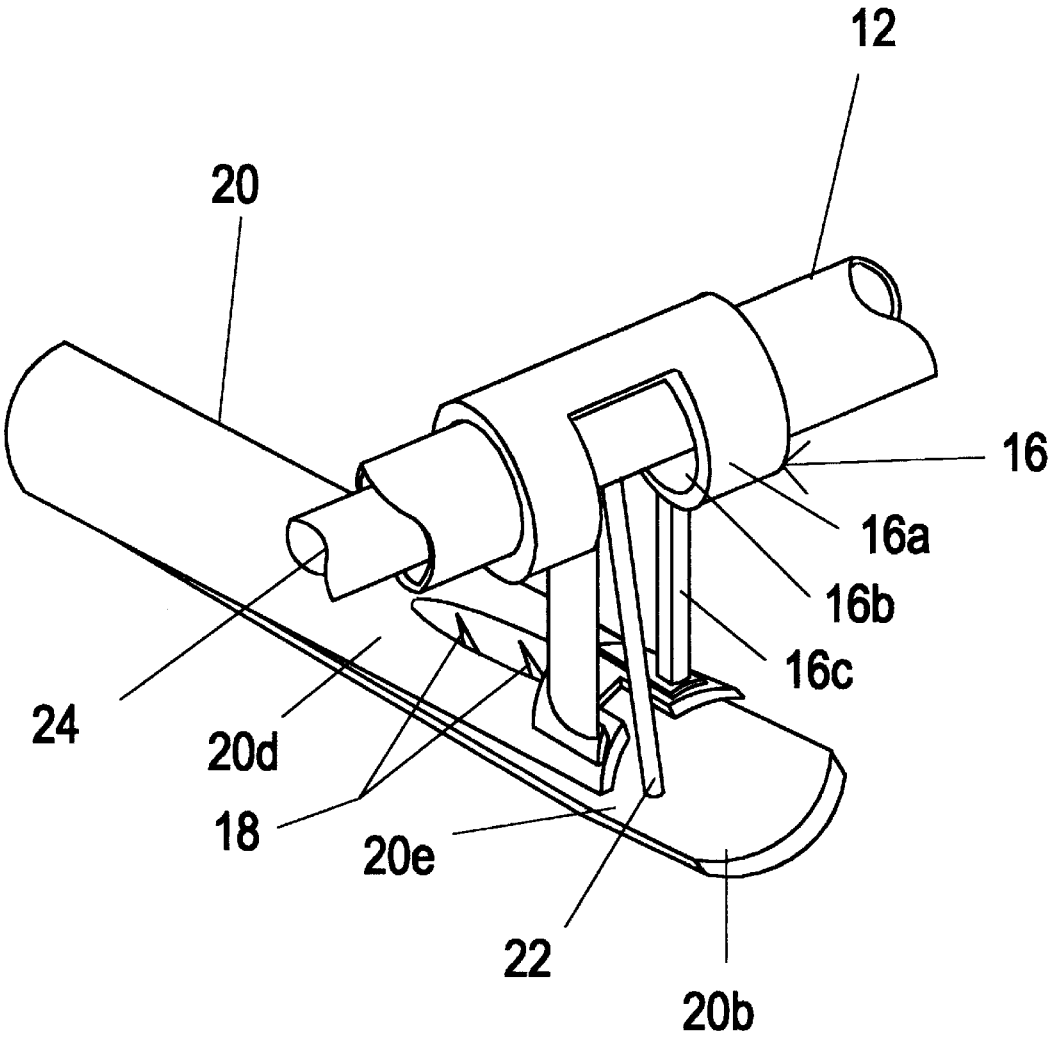
FIG. 5 is a perspective view taken in the direction indicated by lines 5—5 in FIG. 4.
Figure 6:
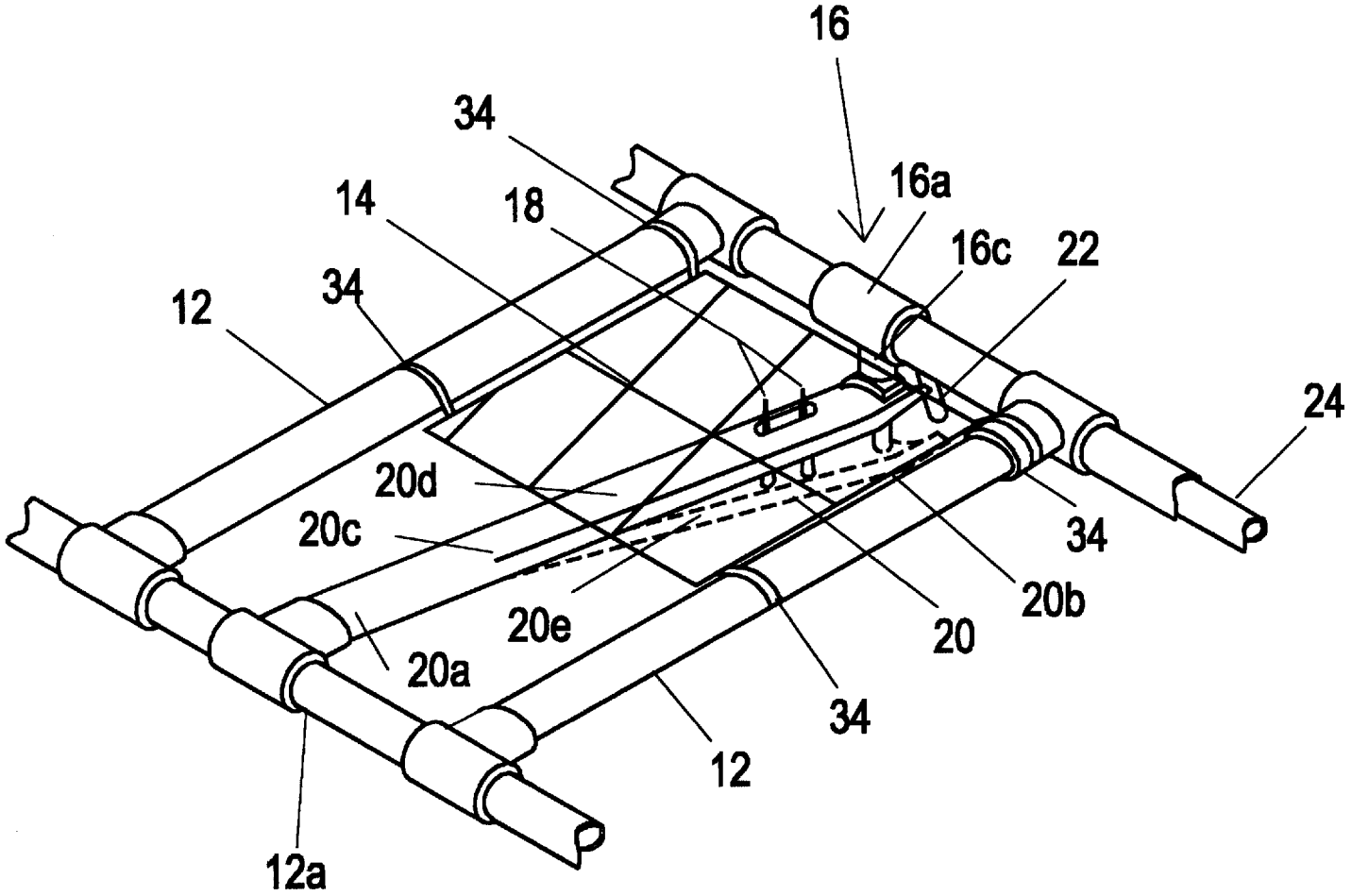
FIG. 6 is an enlarged fragmentary perspective view taken along lines 6—6 of FIG. 1.
Figure 7:
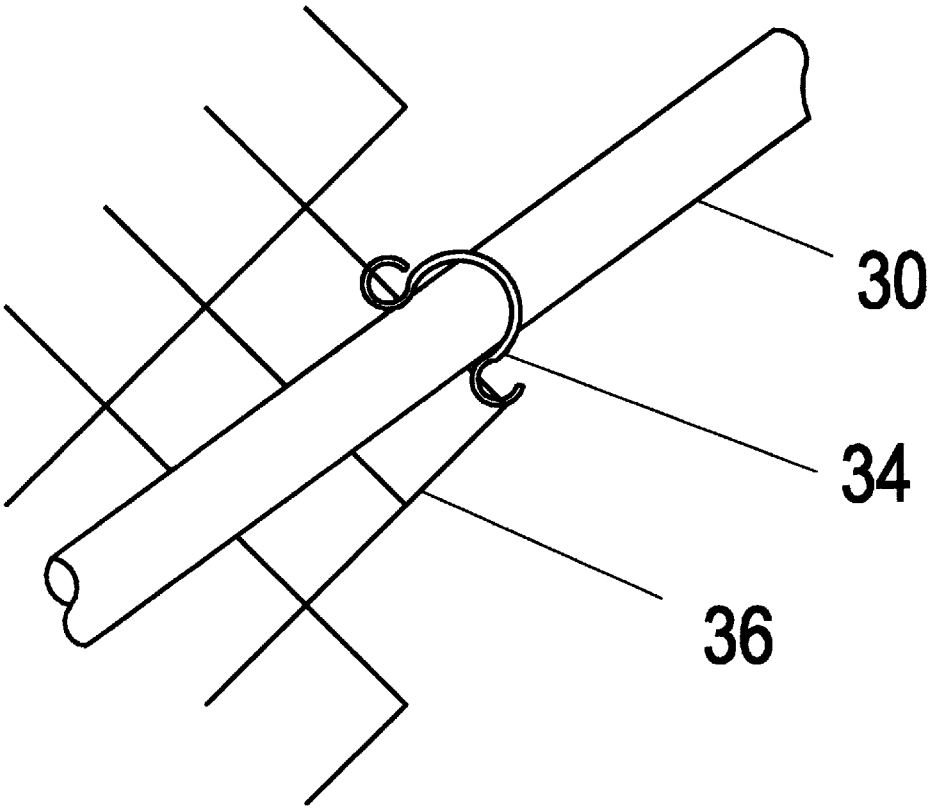
FIG. 7 is an enlarged fragmentary perspective view showing the attachment of hook clips to the protector screen panel.

Referring to the drawings wherein like numerals are used to refer to like parts throughout the several views of the drawings, numeral 10 indicates a water balloon target game made in accordance with a preferred embodiment of the invention. A balloon bursting device 16 is mounted between a pair of a parallel extending, elongated balloon support members 12. As best seen in FIGS. 3 and 4, the balloon bursting device 16 comprises a balloon bursting spring member 20, a plurality of balloon bursting pins 18 secured to the balloon bursting spring member 20 and a cocking pin 22 disposed adjacent to the distal free end of spring member 20. A foraminous balloon support seat 14, such as a wire mesh section (FIG. 2), is suitably secured to balloon support members 12, as with generally U-shaped hook clips 34 attached to opposite sides of support seat 14, at a location aligned so that it is above the balloon bursting device 16. Balloon support members 12 are connected to their opposite ends through transversely extending tubular supports 12*a* and 12*b*, respectively, to a top left horizontal support member 28L and a top right horizontal support member 28R, as viewed in FIGS. 1 and 2. A target 26 is mounted through an arm 26*a* to one end of an elongated connecting rod 24 which is pivotable about its longitudinal axis. The other end of connecting rod 24 is inserted through an aperture 28*a* in the top right horizontal support member 28R, the bore of the tubular support member 12*b* and the bore of the base of a T-shaped tubular portion 16*a* of the balloon bursting device 16. As shown in FIG. 5, the cocking pin 22 is fixed to the connecting rod 24 and extends at an angle of ninety degrees to the longitudinal axis of connecting rod 24 through a cutout slot 16*b* in the base of T-shaped tubular portion 16*a* and is pivotable with connecting rod 24. Cutout slot 16*b* extends generally vertically downwardly from the horizontally extending tubular portion 16*a* through leg 16*c*. Spring member 20 is preferably a cylindrical member having first and second opposite ends 20*a* and 20*b* being split along its longitudinal axis from end 20*b* to a location 20*c* intermediate to its ends forming upper and lower tongue portions 20*d*, 20*e*, respectively. End 20*a* is fixedly attached to support 12*a* and upper tongue 20*d*, slightly shortened to allow space for cocking pin 22, is fixedly attached to the depending leg 16*c* of T-shaped tubular portion 16*a*. Bursting device 16 can be constructed using two conventional T-shaped members, slitting and removing the lower portion of the horizontal tubular portion so that the upper portion 16*d* can be attached to the end portion of tongue portion 20*d*, as by adhesive, and the ninety degree leg can be butted up against the ninety degree leg of T-shaped member 16*a*. An overlapping insert (not shown) can be placed within the two ninety degree legs and attached thereto, as by adhesive, to join the two members together. Bursting pins 18, each having a pointed free distal end, are fixedly attached to the lower spring tongue portion 20*e* and are received through a slot 20*f* formed in upper tongue portion 20*d*. Bursting pins 18 may be formed from screw members threaded through bores formed in the walls of member 20. Cocking pin 22 is oriented generally in the same plane in which the target 26 lies and in a manner so that it protrudes downwardly to engage the distal free end of tongue portion 20*e* of the balloon bursting spring member 20. The center of gravity of target 26 is offset from the longitudinal axis of connecting rod 24 by means of arm 26*a* which provides an effective lever arm as well as resulting in having the connecting rod biased toward a selected orientation with the cocking pin in the cocked position.

Figure 2:
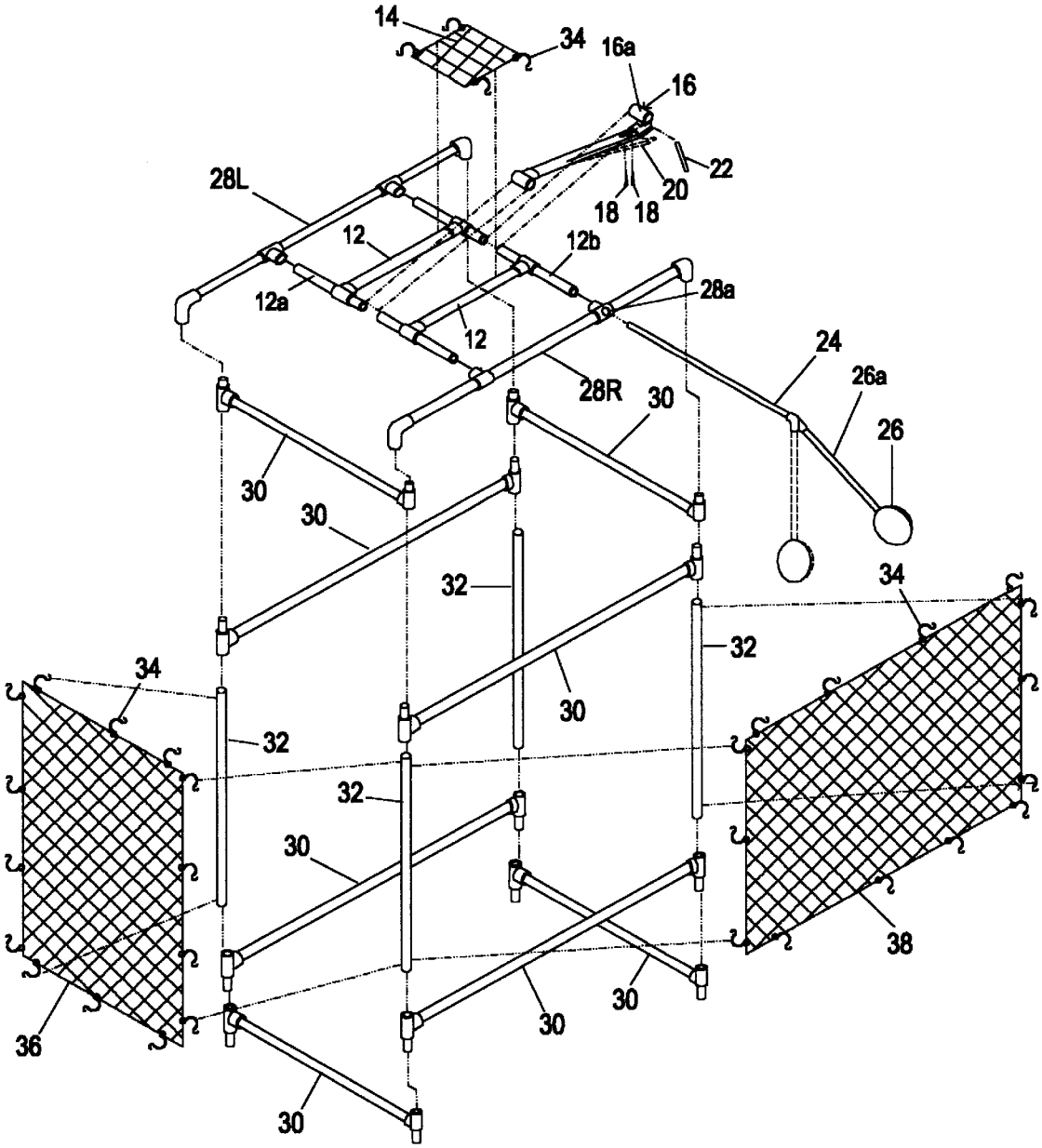
FIG. 2 is an exploded perspective view of the water balloon target game shown in FIG. 1 shown in a slightly smaller scale.
Figure 8:
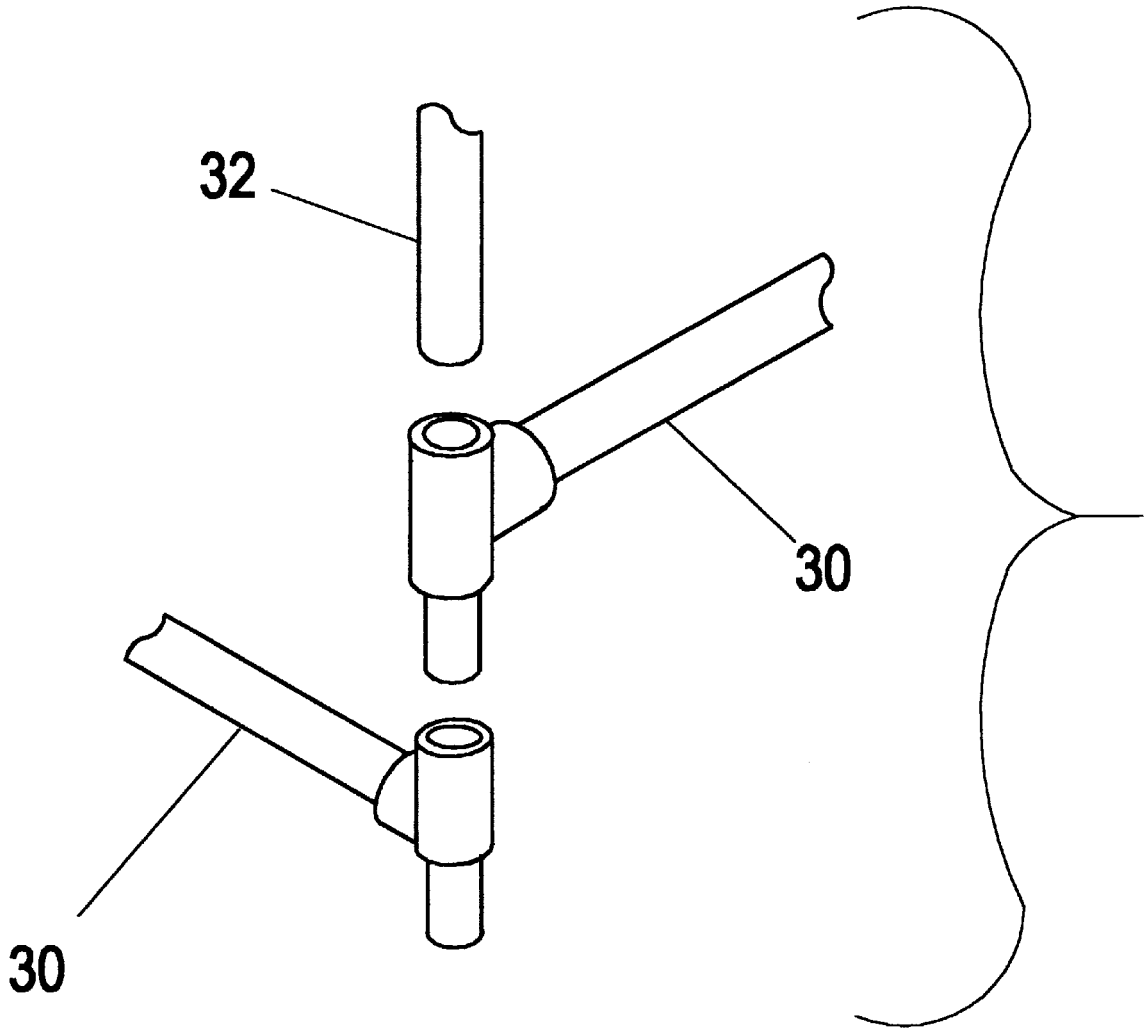
FIG. 8 is an exploded perspective view of the interlocking feature of the support members used in the FIG. 1 target game.

Referring more specifically to FIGS. 2 and 8, a plurality of horizontal support members 30 interlock with each other and vertical base support members 32 to establish a generally parallelepiped frame for the base support structure for top horizontal support members 28L and 28R, balloon support members 12, 12*a* and 12*b*, balloon support seat 14, balloon bursting device 16, connecting rod 24, target arm 26*a* and target 26. A conventional seat (not shown) is centered inside the framework of the base support structure. A front protector screen panel 36 is preferably provided with generally U-shaped hook clips 34 for fastening to the front horizontal base support members 30, and the front vertical base support members 32 which comprise the front of the frame of the water balloon target game 10. A side protector screen 38 is preferably provided with generally U-shaped hook clips 34 for fastening to the right side horizontal base support members 30, and the right side vertical base support members 32 which comprise the target side of the water balloon target game 10.

When it is desired to use the water balloon target game 10, tongue portion 20*e* of balloon bursting spring member 20 is pulled downwardly allowing the connecting rod to rotate through gravity acting on the offset target and with cocking pin 22 pivoting to a vertical position. In the preferred embodiment, the spring or memory characteristics of the material of spring member 20 provides the spring bias to operate the device. Any suitable material, such as PVC conduit, may be used for member 20. Cocking pin 22 serves to engage and hold bursting spring member 20 in the cocked as shown in FIGS. 4, 5. In that position, the balloon bursting pins 18 are retracted away from the foraminous balloon support seat 14. A water balloon (not shown) is then placed on the balloon support seat which is secured to balloon support members 12 by hook clips 34 which, in turn, are supported between the top horizontal support members 28L, 28R, by tubular supports 12*a*, 12*b*. A game participant then positions himself/herself on a seat that is centered inside the assembled base support members 30, 32 behind the participant protector screens 36, 38 and under the water balloon.

In operation, a person stands at some predetermined distance from target 26 and throws a projectile, such as a tennis ball, at target 26. When the target is struck by the ball, the striking force will cause the target to pivot from the dashed line position to the solid line position shown in FIG. 1. This motion is transferred by connecting rod 24 to cocking pin 22 which also pivots away from the distal free end of spring 20 and disengages therefrom. The balloon bursting spring member 20 then returns to its tripped position allowing the balloon bursting pins 18, attached to tongue portion 20*e*, to penetrate past the foraminous balloon support seat 14 and puncture the water balloon. The balloon immediately discharges its contents on top of the game participant to the enjoyment of the ball thrower and any attending audience. The participant protector screens 36, 38 which are secured to the base support members by hook clips 34 keep the participant safe from any misdirected projectiles without obscuring him or her from view.

Thus it will be seen that the water balloon target game made in accordance with the invention is safer than prior art water entertainment target games that plunge and submerge game participants into large volumes of water. The participant in the present invention stays seated behind a participant protector screen shielded from accidental contact by misdirected projectiles but in full view of game players and observers, and the drenching effect that makes the game exciting is the result of the water dropping onto the game participant, not the reverse. The entertainment value derived from the challenge and skill required to hit a target is further enhanced by the instant enjoyment generated from the immediate discharge of the water balloon on the game participant. As noted above, some prior art water games incorporate a time delay feature that gives the participant time to prepare for the drenching or even time to evacuate the area and escape from being drenched. The present invention can operate with a large variety of sizes of water balloons making it possible to choose the amount of water discharged each time the game is played. Because the discharge is directly above the game participant and not off to one side, even the smallest balloons have maximum effect. The preferred embodiment of the invention is easily assembled and disassembled, simple to operate and can be used anywhere without regard to the availability of a pressurized water source.

It should be realized that although the preferred embodiment of the invention has been described by way of illustrating the invention, the invention includes all modifications and equivalents of the disclosed embodiment falling within the scope of the appended claims. For example, it is within the purview of the invention to mount tongue portion with a hinge and to provide a separate spring member to bias the tongue portion and bursting pin toward the tripped position.

What is claimed:

1. A water balloon target game comprising a frame enclosing a game participant location adapted to receive a game participant seat, the frame including a foraminous balloon support seat vertically aligned with and above the game participant location, a balloon bursting device mounted on the frame adjacent to the balloon support seat, the balloon bursting device including a member having a free distal end movable between a first balloon bursting position and a second cocked position and being biased toward the first position, a balloon bursting pin mounted on the member and extending through the foraminous balloon support seat when the member is in the first position and away from the foraminous balloon support seat when the member is in the second position, a connecting rod having a longitudinal axis and first and second opposite ends rotatably mounted on the frame for rotation about the longitudinal axis, a radially extending cocking pin fixedly attached to the connecting rod and aligned with the distal free end of the member and being engageable with the member when the member is in the second position and when the cocking pin is disposed in a selected angular orientation, and a target having a face surface attached to an end of the connecting rod and offset from the longitudinal axis whereby a selected force applied to the face surface of the target will cause the connecting rod to pivot moving the cocking pin away from the member allowing the member to move to the first position with the balloon bursting pin received through the foraminous balloon support seat to burst a water filled balloon received on the foraminous balloon support seat.

2. A water balloon target game according to claim 1 in which the member has a generally elongated, cylindrical configuration having a longitudinal axis and being formed of material having a selected elastic limit with the elongated cylindrical member being split along the longitudinal axis from the distal free end for a selected length forming an upper and a lower portion, the lower portion mounting the balloon bursting pin and including the movable free end and a slot being formed in the upper portion aligned with the balloon bursting pin.

3. A water balloon target game according to claim 2 in which the upper portion of the elongated, cylindrical member is connected to a fixed T-shaped tubular member, the connecting rod being rotatably received within the fixed T-shaped tubular member and an aperture is formed in the fixed T-shaped tubular member aligned with the elongated, cylindrical member, the cocking pin extending from the connecting rod through the aperture for engagement with the lower portion of the elongated, cylindrical member.

4. A water balloon target game according to claim 1 in which the frame includes spaced water balloon support members and the foraminous balloon support seat comprises a wire mesh screen having clips attached to the spaced balloon support members of the frame.

5. A water balloon target game according to claim 1 further comprising screen panels having attachment clips engageable with the frame, a screen panel clipped to the frame in front of the game participant location and a screen panel clipped to the side of the frame adjacent to the target.

6. A water balloon target game according to claim 1 in which the frame comprises a plurality of horizontally and vertically elongated members having interfitting male and female sockets with press fit connections.

7. A water balloon target game according to claim 1 further comprising an arm interconnecting the target and the connecting rod and extending in a given direction and the cocking pin extends from the connecting rod in approximately the given direction.

8. A water balloon target game comprising:

a frame defining a game participant location, a balloon support seat mounted on the frame generally vertically aligned with the game participant location, a balloon bursting device having a piercing member movable between a first position with a portion thereof extending into the balloon support seat and a second position removed from the balloon support seat, the piercing member being biased toward the first position, a connecting rod having first and second ends and a longitudinal axis and being rotatable about the longitudinal axis mounted on the frame with the first end positioned adjacent to the balloon bursting device and the second end disposed exteriorly of the frame, a target connected to the second end of the connecting rod and being removed from the longitudinal axis and a cocking pin extending radially from the connecting rod adjacent to the first end, the connecting rod engaging the piercing member when the piercing member is in the second position and with the connecting rod in a selected angular orientation preventing movement of the piercing member toward the first position, the piercing member moving to the first position when the connecting rod rotates away from the selected angular position due to a force exerted on the target when struck by a projectile allowing the piercing member to move to the first position.

9. A water balloon target game according to claim 8 in which the piercing member is elongated and a piercing pin is mounted to extend therefrom.

10. A water balloon target game according to claim 9 in which the elongated member is generally cylindrical with a longitudinal axis and the elongated member is split for a selected distance along the longitudinal axis forming an upper portion and a lower portion, the upper portion being shortened slightly to provide space for the cocking pin to engage with the distal free end of the lower portion.

11. A water balloon target game according to claim 10 in which the piercing pin is mounted on the lower portion and a slot is formed on the upper portion in alignment with the piercing pin.

12. A water balloon target game according to claim 8 in which the balloon support seat is formed of a wire mesh.

13. A water balloon target game according to claim 8 further comprising a screen mounted on the frame in front of the game participant location.

14. A water balloon target game according to claim 8 further comprising a screen mounted between the target and the game participant location.

* * * * *